US008590164B2

(12) United States Patent
Noble et al.

(10) Patent No.: US 8,590,164 B2
(45) Date of Patent: Nov. 26, 2013

(54) TABLET CUTTER WITH SLIDE GUIDE AND METHODS

(75) Inventors: Terrance O. Noble, Burnsville, MN (US); Robert N. Priebe, Bloomington, MN (US)

(73) Assignee: Apothecary Products, Inc., Burnsville, MN (US)

( * ) Notice: Subject to any disclaimer, the term of this patent is extended or adjusted under 35 U.S.C. 154(b) by 355 days.

(21) Appl. No.: 12/880,729

(22) Filed: Sep. 13, 2010

(65) Prior Publication Data

US 2012/0060374 A1 Mar. 15, 2012

(51) Int. Cl.
*B26F 3/02* (2006.01)
*B26B 11/00* (2006.01)

(52) U.S. Cl.
USPC ..... 30/124; 225/104; 225/105

(58) Field of Classification Search
USPC ..... 30/124; 225/103, 104, 105
See application file for complete search history.

(56) References Cited

U.S. PATENT DOCUMENTS

| | | | |
|---|---|---|---|
| 2,095,330 | A | 10/1937 | Hedgpeth |
| 2,352,235 | A | 6/1944 | Tautz |
| 2,418,958 | A | 4/1947 | Stock |
| 2,655,259 | A | 10/1953 | Davoren |
| 3,175,746 | A | 3/1965 | Gordon et al. |
| 3,349,821 | A | 10/1967 | Moeller |
| 3,439,664 | A | 4/1969 | Sylvester |
| 3,517,871 | A | 6/1970 | Gaffney et al. |
| 3,678,884 | A | 7/1972 | Robbins |
| 3,815,802 | A | 6/1974 | Stevens |
| 4,009,651 | A | 3/1977 | Adams |
| 4,179,806 | A | 12/1979 | Lieptz |
| 4,199,863 | A | 4/1980 | Deckert |
| 4,422,553 | A | 12/1983 | Hoeks et al. |
| 4,825,552 | A | 5/1989 | Bendickson et al. |
| 4,879,932 | A | 11/1989 | Scalise et al. |
| 4,989,746 | A | 2/1991 | Pierce |
| 5,020,037 | A | 5/1991 | Raven |
| 5,118,021 | A | 6/1992 | Fiocchi |
| 5,203,245 | A | 4/1993 | Terpstra |
| 5,417,359 | A | 5/1995 | Zellner |
| 5,513,548 | A | 5/1996 | Garuglieri |
| 5,537,748 | A | 7/1996 | Takahashi et al. |
| 5,690,268 | A | 11/1997 | Evans et al. |
| 5,944,243 | A | 8/1999 | Weinstein |

(Continued)

FOREIGN PATENT DOCUMENTS

| | | | |
|---|---|---|---|
| DE | 20 2005 018 139 | U1 | 3/2006 |
| EP | 0 313 934 | A2 | 10/1987 |
| WO | WO 2005/030117 | A2 | 4/2005 |

OTHER PUBLICATIONS

Exhibits A1-A3, Apex Carex Healthcare Products Inc. Pill Cutter; available prior to Mar. 14, 2005; 3 pages.

(Continued)

*Primary Examiner* — Hwei C Payer
(74) *Attorney, Agent, or Firm* — Merchant & Gould P.C.

(57) ABSTRACT

A pill splitter includes a base, a cover pivotably secured to the base, a cutting blade attached to the cover, and a pill holder arrangement. The pill holder arrangement includes a slideable fixture constructed and arranged to be movable relative to the base and hold the pill. The pill holder arrangement allows a pill to split when the cover is moved in a closed position.

15 Claims, 9 Drawing Sheets

(56) References Cited

U.S. PATENT DOCUMENTS

| | | | | |
|---|---|---|---|---|
| 6,419,275 | B1 | 7/2002 | Huault | |
| 6,449,218 | B1 | 9/2002 | Lluch | |
| 6,474,525 | B1 | 11/2002 | Reitano | |
| 6,502,311 | B1 | 1/2003 | Khachatoorian et al. | |
| 6,527,155 | B2 | 3/2003 | Buckley et al. | |
| 6,557,945 | B1 | 5/2003 | Eric | |
| 6,601,746 | B2 | 8/2003 | Buckley et al. | |
| 7,080,768 | B2 | 7/2006 | Marks | |
| 7,140,511 | B2 | 11/2006 | Baker et al. | |
| 7,243,826 | B2 | 7/2007 | Darst | |
| 7,673,778 | B2 | 3/2010 | Sze | |
| 7,828,181 | B1 * | 11/2010 | Reitano | 225/1 |
| 2002/0179669 | A1 | 12/2002 | Buckley et al. | |
| 2003/0019900 | A1 | 1/2003 | Dienst | |
| 2005/0067452 | A1 | 3/2005 | Darst | |
| 2009/0183373 | A1 * | 7/2009 | Suhr | 30/124 |

OTHER PUBLICATIONS

Exhibits B1-B2, Quanterron Inc.Pill Cutter; available prior to Mar. 14, 2005; 2 pages.

Exhibits C1-C4, Links Medical Products' AccuCut Rx™ Personal Tablet Cutter; available prior to Mar. 14, 2005; 4 pages.

Exhibits D1-D4, Pill Cutter; available prior to Mar. 14, 2005; 4 pages.

Exhibits E1-E5, Pill Cutter; available prior to Mar. 14, 2005; 5 pages.

Exhibits F1-F4, NewDay Corporation, Apex Carex Inc. Pill Cutter; available prior to Mar. 14, 2005; 4 pages.

Exhibits G1-G5 Pill Cutter; available prior to Mar. 14, 2005; 5 pages.

Exhibit H, Health Care Logistics Inc. Blue Tablet Cutter with Window; available prior to Mar. 14, 2005; 1 page.

Exhibit I, Apex Medical Corporation Pill Splitter (Blue); available prior to Mar. 14, 2005; 1 page.

Exhibit J, Apex Medical Corporation Pill Splitter (Orange); available prior to Mar. 14, 2005; 1 page.

Exhibit K1-K2, Apro Corporation Pill Cutter, U.S. Patent No. 4,422,553; available prior to Mar. 14, 2005; 2 pages.

Exhibits L1-L3, Apothecary Products, Inc. Pill Cutter; available prior to Mar. 14, 2005; 3 pages.

Exhibits M1-M4, Apothecary Products, Inc. Adult Lock® Pocket Pill Cutter; available prior to Mar. 14, 2005; 4 pages.

Exhibits N1-N2, Apothecary Products, Inc. Adult Lock® Pocket Pill Cutter; available prior to Mar. 14, 2005; 2 pages.

* cited by examiner

TABLET CUTTER WITH SLIDE GUIDE AND METHODS

TECHNICAL FIELDS

This disclosure relates to tablet cutters. In particular, this disclosure relates to an improved tablet cutter that allows for accurate cuts of a tablet.

BACKGROUND

Tablets or pills are not always manufactured in dosages small enough to satisfy the needs of consumers. For example, dosages appropriate for small children or adults who are sensitive to particular medication are often less than the dosage contained in one tablet or pill. In addition, some individuals find it difficult to swallow large pills and would prefer breaking a large pill into smaller parts before consumption.

The Assignee of this disclosure has a previous patent on a tablet cutter, U.S. Pat. No. 7,673,778, which is incorporated herein by reference. Improvements are desirable.

SUMMARY

A pill splitter is provided including a base, a cover pivotably secured to the base, a cutting blade attached to the cover, and a pill holder arrangement. The pill holder arrangement includes a slideable fixture constructed and arranged to be movable relative to the base and hold the pill. The pill holder arrangement allows a pill to split when the cover is moved in a closed position.

In another aspect, a pill splitter is provided including a base, a cover pivotably secured to the base, a cutting blade attached to the cover, and means for adjustably clamping a pill to be split.

In another aspect, a method of splitting a pill includes providing a pill splitter having a base, a cover pivotably connected to the base, and a cutting blade attached to the cover. Next, there is a step of placing a pill in a pill holder in the base. Next, there is a step of pushing a slideable fixture to secure the pill in the pill holder. Next, there is a step of closing the cover over the base to engage the cutting blade against the pill and split the pill within the pill holder.

DETAILED DESCRIPTION

A. Some Problems with Existing Arrangements

In existing pills splitters, it can be difficult to center the pill or tablet in order to achieve an even split. As used herein, the terms "pill" and "tablet" are used interchangeably and are intended to mean the same thing. The problem can be exasperated if the person splitting the pill has impaired eyesight or dexterity.

There is a need, therefore, for a pill splitter that helps to achieve a uniformly and evenly split pill, even when the person splitting the pill has impaired eyesight and/or dexterity.

B. Example Embodiment

FIGS. 1-17

Figure 1:
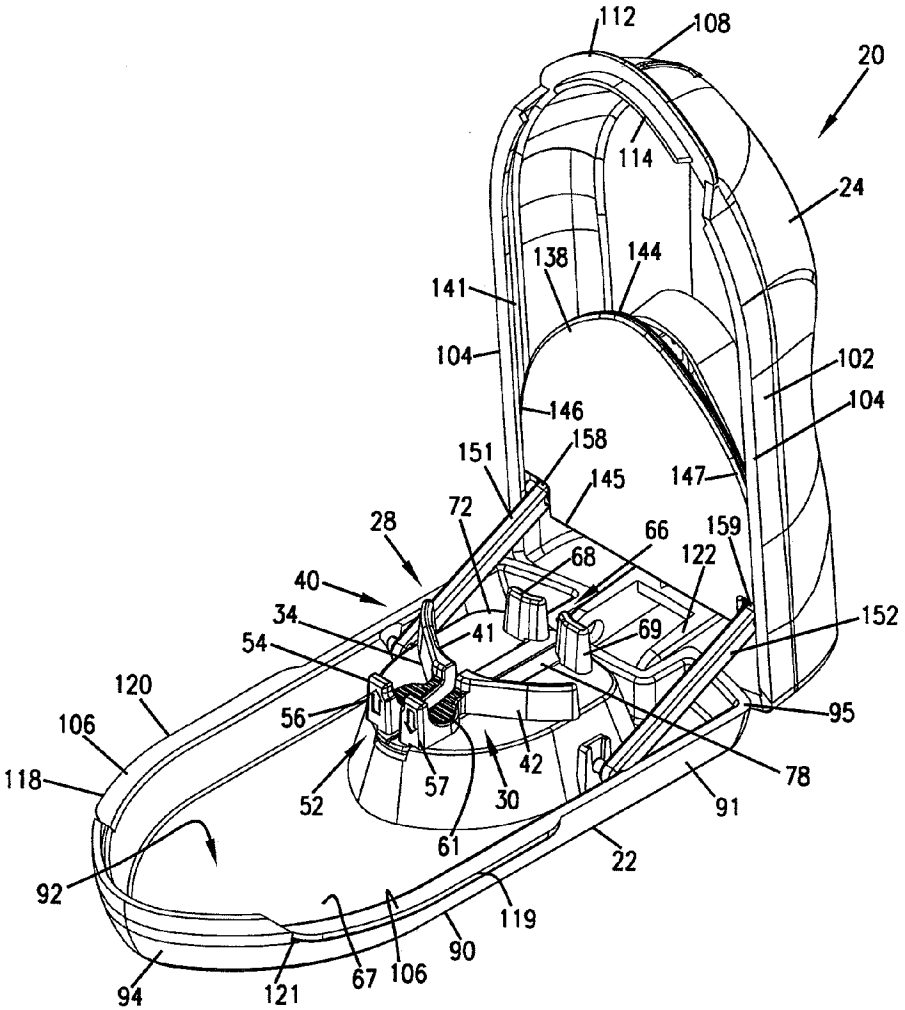
FIG. 1 is a perspective view of an embodiment of a pill splitter with a cover in an open position.
Figure 2:
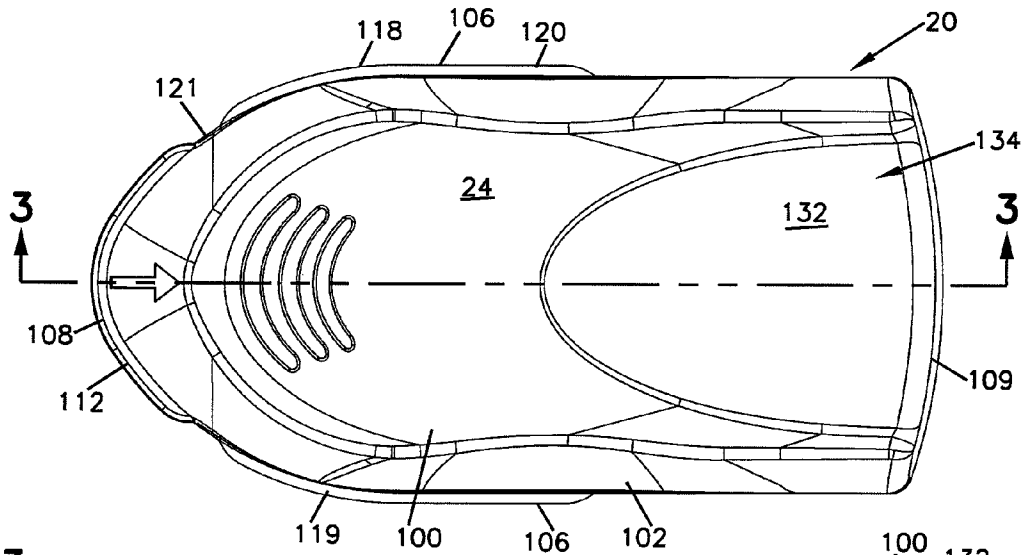
FIG. 2 is a top plan view of the pill splitter of FIG. 1, but showing the pill splitter with the cover in a closed position.

In reference now to FIG. 1, an embodiment of a pill splitter is shown in perspective view generally at 20. In this embodiment, the pill splitter 20 includes a base 22, which is the normal "bottom" or portion that rests against another surface, such as a table or countertop.

Figure 4:
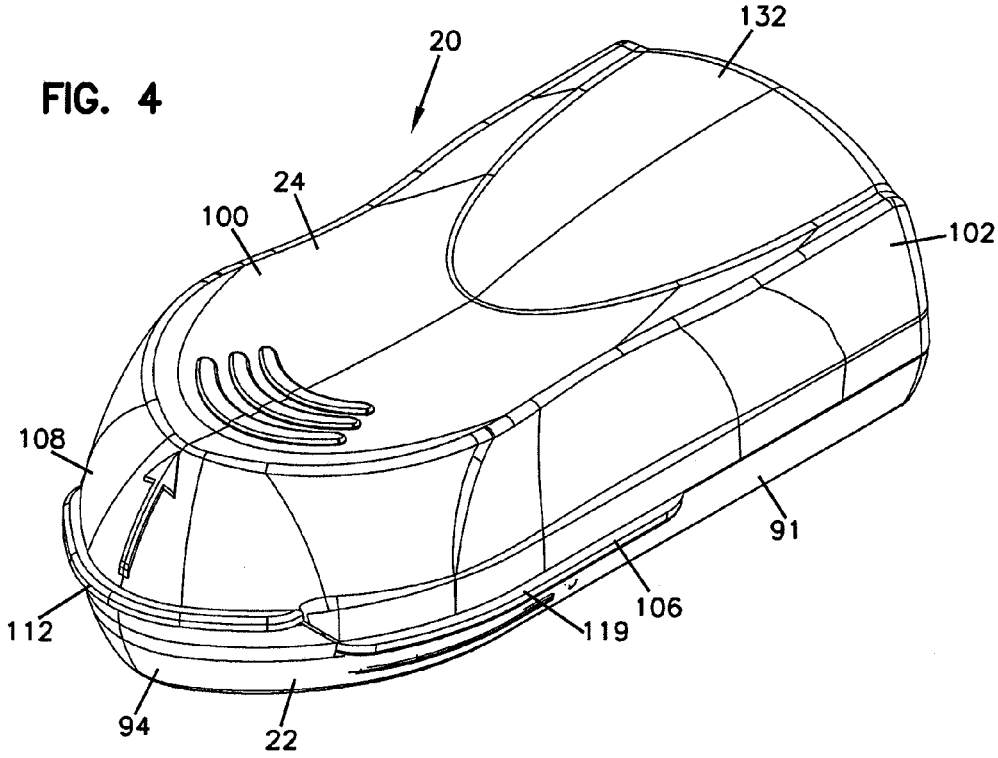
FIG. 4 is a perspective view of the pill splitter of FIGS. 1-3 showing the cover in a closed position.

In general, a cover 24 is part of the pill splitter 20. In this embodiment, the cover 24 is secured to the base 22, and in the example shown, is pivotably secured to the base 22. As can be seen by comparing FIGS. 1 and 4, the cover 24 is pivotable between an open position (FIG. 1) and a closed position (FIG. 4). In the open position, the cover 24 is away from the base 22, which exposes the internal structure of the pill splitter 20 and the top portion of the base 22. The closed position, as shown in FIG. 4, is the position in which the cover 24 is over the base 22, and the base 22 is covered by the cover 24.

Figure 3:
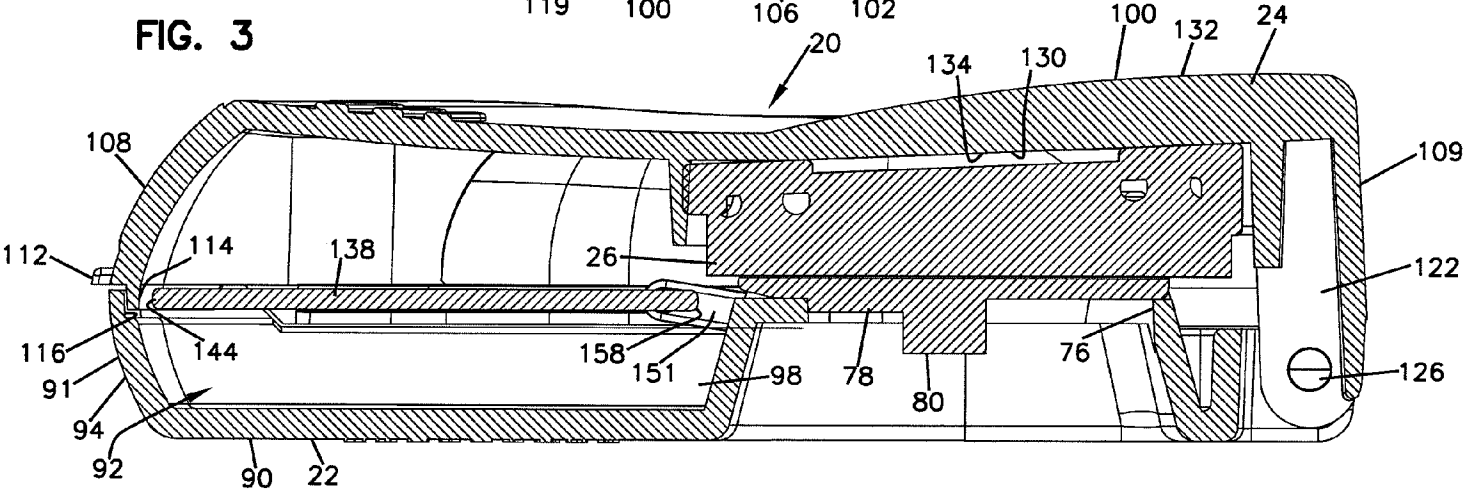
FIG. 3 is a cross-sectional view of the pill splitter of FIG. 2, the cross-section being taken along the line 3-3 of FIG. 2.

In general, the pill splitter 20 includes a cutting blade 26 (FIG. 3). In this embodiment, the cutting blade 26 is attached or secured to the cover 24. The cutting blade 26 is provided to cut a tablet that is being held by the base 22.

Figure 17:
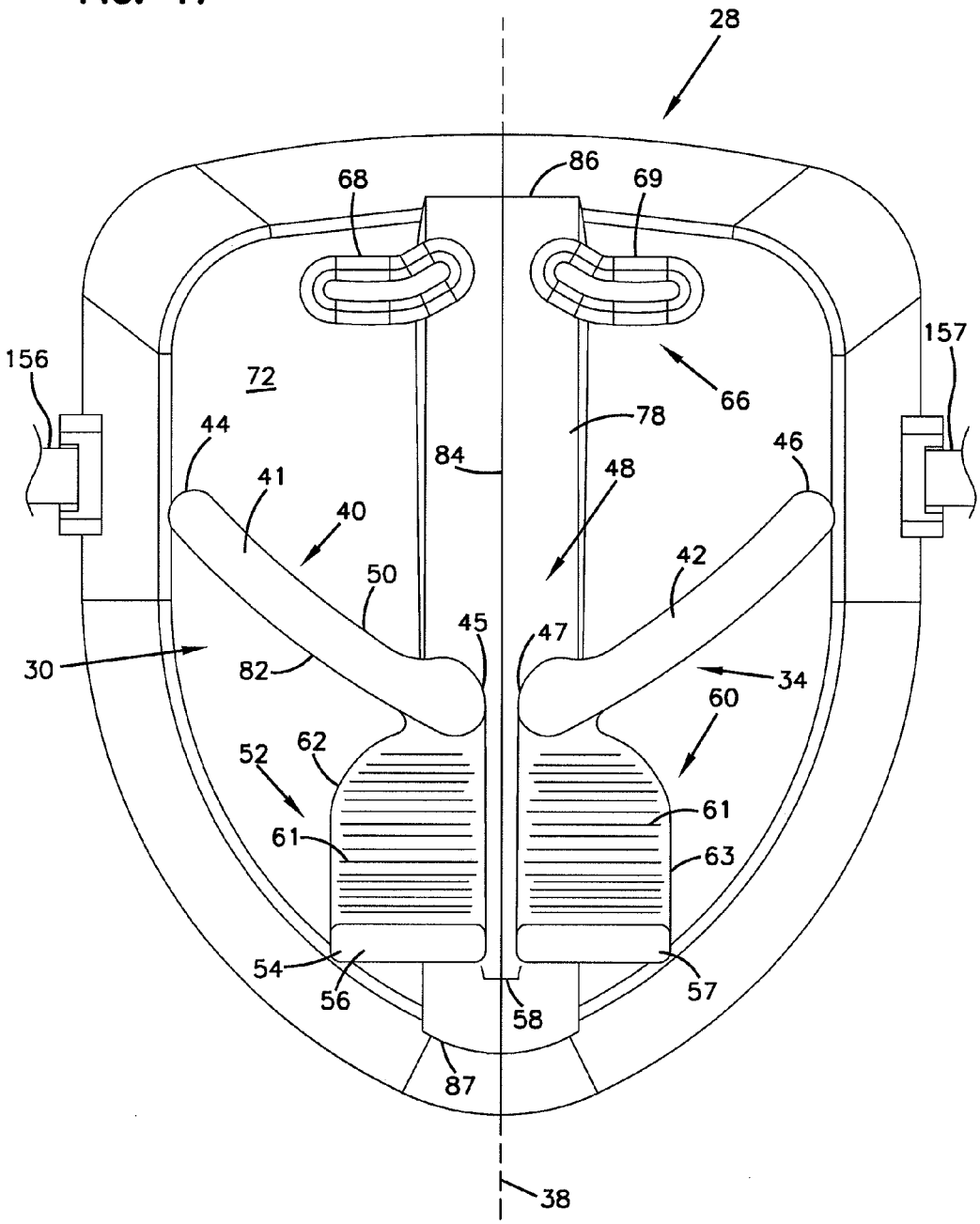
FIG. 17 is an enlarged top view of one embodiment of the pill holder arrangement used in the pill splitter of FIGS. 1-4.

In accordance with principals of this disclosure, the pill splitter 20 further includes a pill holder arrangement 28 (FIGS. 1 and 17). The pill holder arrangement includes means 30 for adjustably clamping a pill to be split. Means 30 is described in further detail below.

Figure 16:
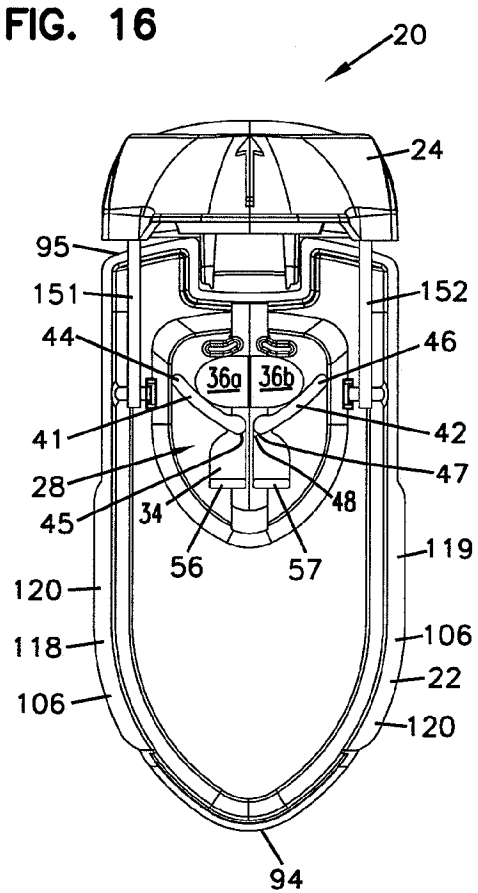
FIG. 16 is a top view of the pill splitter of FIGS. 1-4 showing another step of a method of use.
Figure 15:
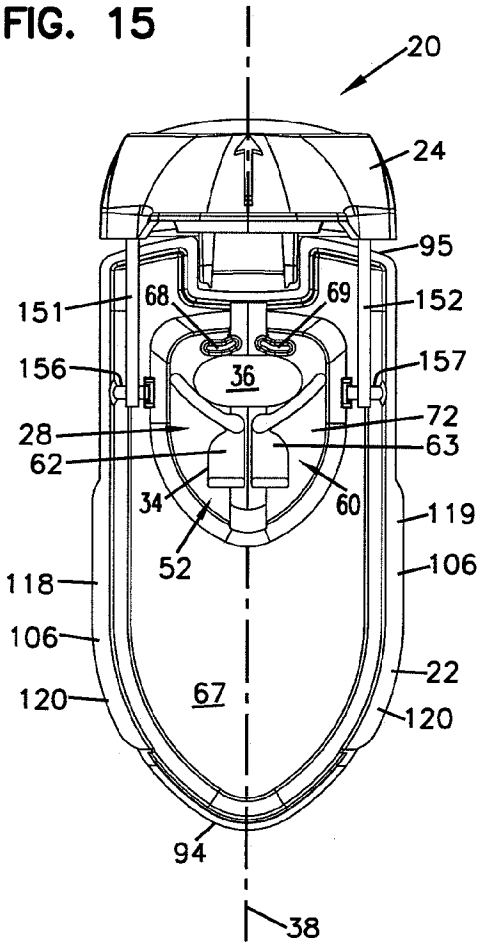
FIG. 15 is a top view of the pill splitter of FIGS. 1-4 showing another step of a method of use.
Figure 14:
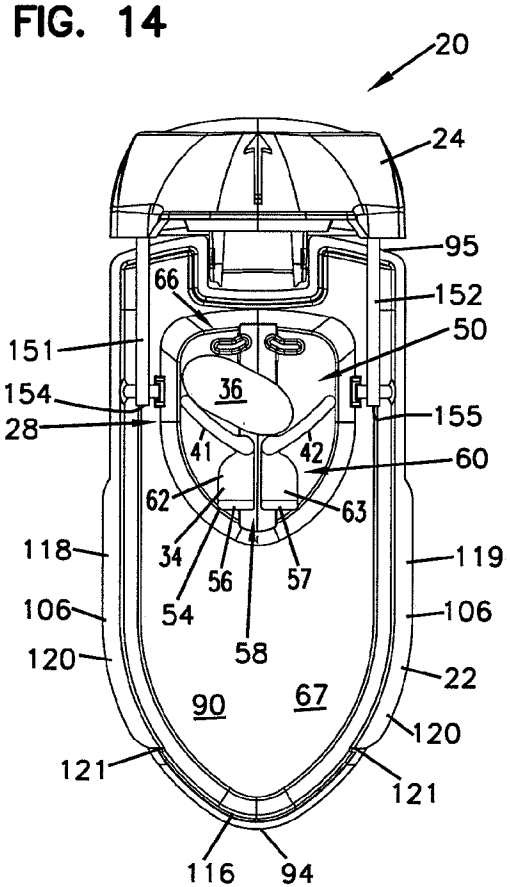
FIG. 14 is a top view of the pill splitter of FIGS. 1-4 showing one step of a method of use.

As embodied herein, the means 30 for adjustably clamping a pill to be split includes a slidable fixture 34. By comparing FIGS. 14 and 15, it can be seen how the slidable fixture 34 is slidable or movable from a first, pill-loading position (FIG. 14) to a second, clamped position (FIG. 15). In FIG. 14, a pill 36 can be seen resting askew within the pill holder arrangement 28. In FIG. 15, the pill 36 can be seen clamped into position, held steady in place, and in alignment such that a center longitudinal axis 38 bisects the pill 36 into two parts 36*a* and 36*b* (FIG. 16).

While a variety of implementations are contemplated, in the particular one shown in the drawings, the slidable fixture 34 includes an arm arrangement 40. The arm arrangement 40, in the one shown, has at least one arm 41 to provide a movable stop in order to hold the pill 36. In the embodiment shown, there is also a second arm 42. While a variety of embodiments are contemplated, this embodiment depicts the arm arrangement 40 as being arched, in that the arms 41, 42 generally form a curved or bow shape.

In particular, and in reference to FIG. 17, arm 41 has a first end 44 and a second end 45. The first end 44 is oriented closer to the portion in which the cover 24 connects to the base 22, than the second end 45. Similarly, the arm 42 includes a first end 46 and a second end 47. The first end 46 is located closer to the portion in which the cover 24 connects to the base 22 than the second end 47. In general, the first ends 44, 46 are even with each other, in that a straight line that connects each first end 44, 46 will also be a line that is perpendicular to the central longitudinal axis 38. The respective second ends 45, 47 are located adjacent to each other.

In this embodiment, the arms 41, 42 are slightly arched. Arms 41, 42 are on a radius of 20-30 millimeters, for example, 24-26 millimeters. This size accommodates most pill sizes.

In general, the arm arrangement 40 is shaped to include a bight section 48. The bight section 48, in this embodiment, is the section where the respective second ends 45, 47 are adjacent to each other. The arm arrangement 40, shaped in this manner, forms a cradle 50 for the pill 36.

In this embodiment, there is a finger tab 52 (FIG. 1) constructed and arranged to accept force and move the means 30 relative to the base 22. As embodied herein, the finger tab 52 is part of the slidable fixture 34. While a variety of embodiments are contemplated, the finger tab 52 in the embodiment shown is connected to the arm arrangement 40. The finger tab 52, in the embodiment depicted, has a projection 54 extending in a direction toward the cover 24, when the cover 24 is in the closed position (FIG. 4). The projection 54 is spaced from the arm arrangement 42 sufficiently to accommodate the finger of a person.

Many different embodiments are possible. In the embodiment shown, the projection 54 includes first and second projections 56, 57 with a gap 58 (FIG. 17) therebetween. The axis 38 is collinear and aligned with the gap 58. As explained below, the gap 58 will accommodate the cutting blade 26. Connecting the first and second projections 56, 57 to the first and second arms 41, 42 is a bridge arrangement 60. In this embodiment, the bridge arrangement 60 has ribs 61 to help provide a gripping surface for a person's finger. The bridge arrangement 60 is shown in this embodiment as first and second bridges 62, 63, separated by gap 58. The first bridge 62 connects the first projection 56 to the first arm 41, while the second bridge 63 connects the second projection 57 to the second arm 42. Again, this is just one example embodiment, in which a variety of embodiments are possible.

Still in reference to FIG. 17, the pill holder arrangement 28 preferably includes a rigid back projection arrangement 66 facing and opposing the arm arrangement 40. In this embodiment, the back projection arrangement 66 is located closer to the area in which the cover 24 is connected to the base 22 than the arm arrangement 40 is. In this embodiment, the back projection arrangement 66 is constructed and arranged to cooperate with the means 30 for adjustably clamping a pill to be split to hold the pill 36 so that it can be split. In particular, in the embodiment depicted, the rigid back projection arrangement 66 cooperates with the slidable fixture 34 such that the pill 36 can be braced against the back projection arrangement 66 and the arms 41, 42.

In the embodiment shown, the back projection arrangement includes a first back projection 68 and a second back projection 69, separated by gap 58. The first and second back projections 68, 69, in the embodiment shown, are somewhat curved such that the convex part of the curve is facing the arm arrangement 40, while the concave part of the curve is facing the portion of the pill splitter 20 in which the cover 24 connects to the base 22.

As can be seen in FIGS. 14-16, the pill 36 is placed in the pill holder arrangement 28, then a person puts her finger against the finger tab 52 (FIGS. 1 and 15) and moves the slidable fixture 34 having the arm arrangement 40 in a direction toward the back projection arrangement 66. The pill 36 is then straightened by the force between the first and second back projections 68, 69 and the first and second arms 41, 42.

In using the finger tab 52, the person may either place just a finger against the projection arrangement 54; alternatively, a person may place a finger on the bridge arrangement 60 in order to move the slidable fixture 34 in a direction toward the back projection arrangement 66.

In accordance with principals of this disclosure, the pill holder arrangement 28, in preferred embodiments, includes a platform 72. The platform 72 is raised in height relative to a remaining portion of the base 22. In general, the platform 72 holds the slidable fixture 34 and back projection arrangement 66 vertically above and off of a remaining portion 67 of the base 22. Typically, the platform 72 is at least 2 millimeters above the remaining portion 67 of the base 22, for example 5-15 millimeters above the base 22, and often less than 20 millimeters above the base 22.

Figure 8:
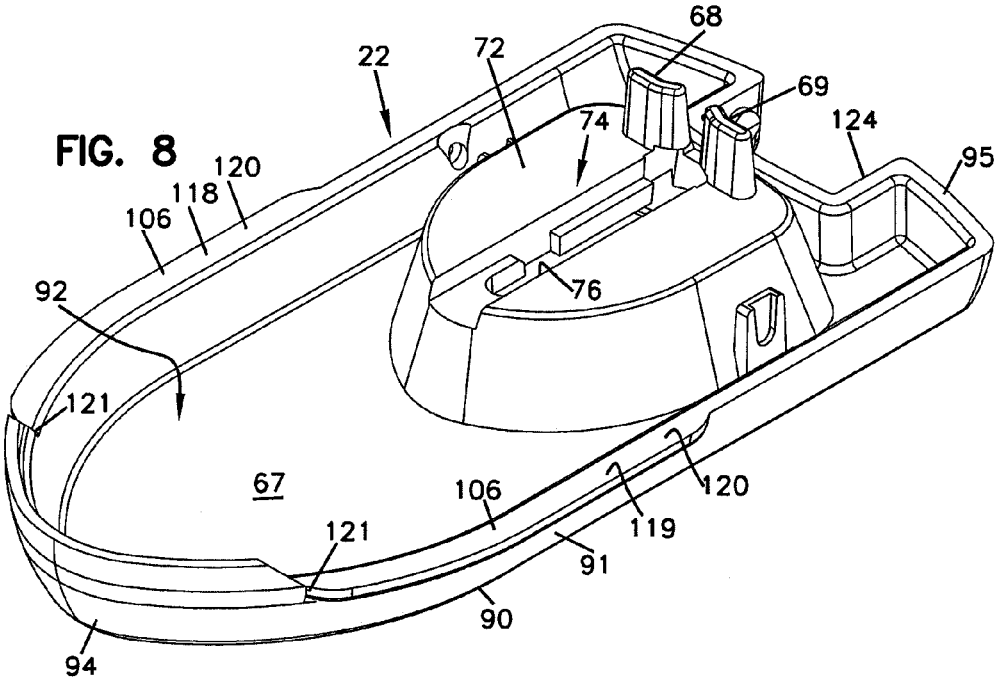
FIG. 8 is a perspective view of the base of the pill splitter of FIGS. 1-4, but with the pill holder arrangement structure being removed for clarity.
Figure 5:
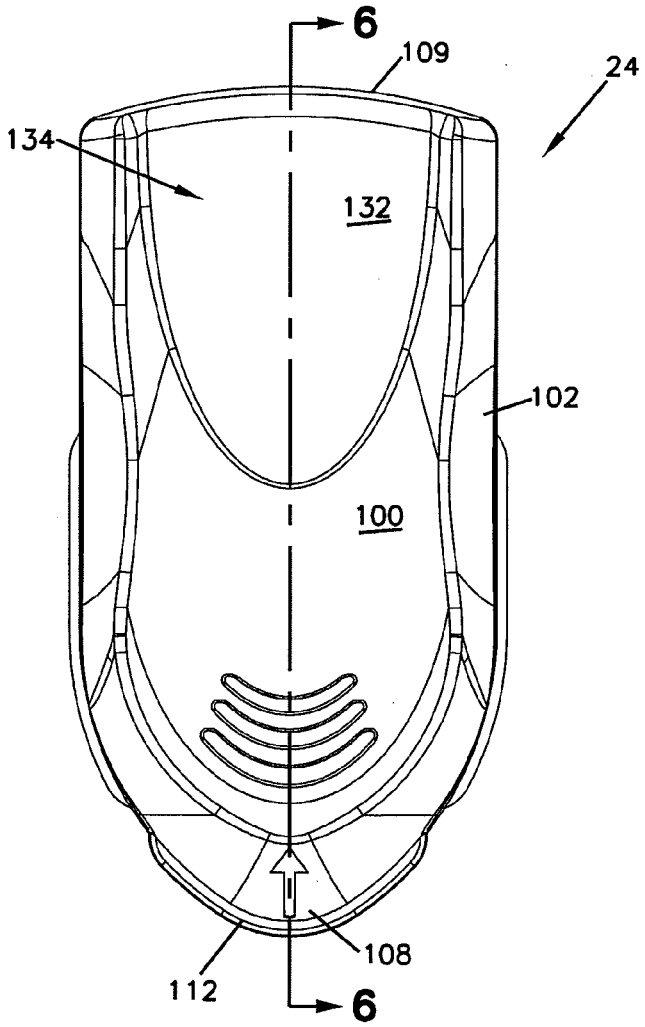
FIG. 5 is a top plan view of the cover of the pill splitter of FIGS. 1-4.
Figure 9:
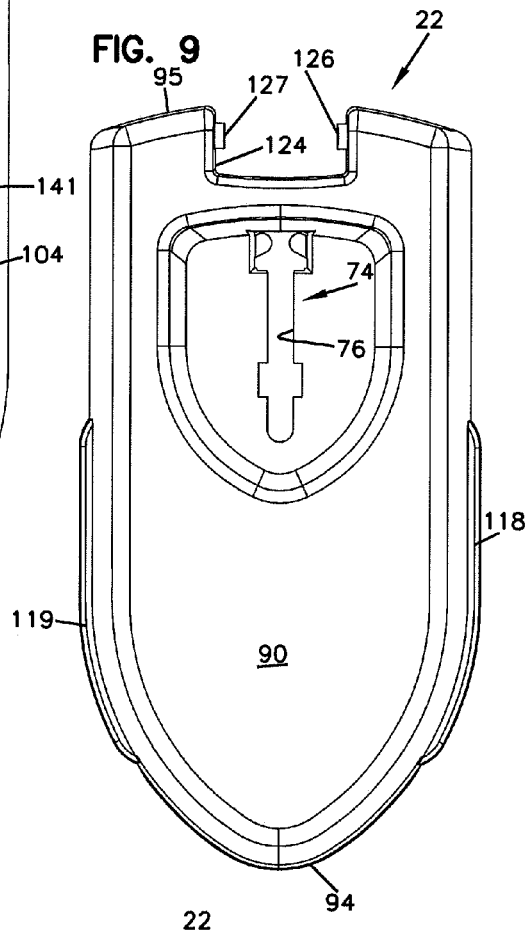
FIG. 9 is a bottom plan view of the base of FIG. 8.
Figure 11:
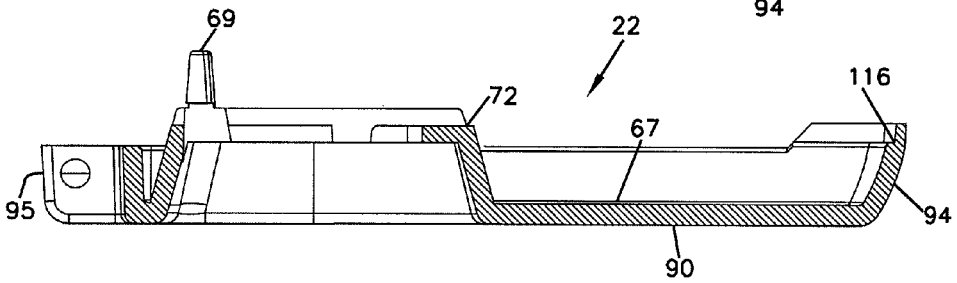
FIG. 11 is a cross-sectional view of the base of FIG. 8, the cross-section being taken along the line 11-11 of FIG. 10.
Figure 10:
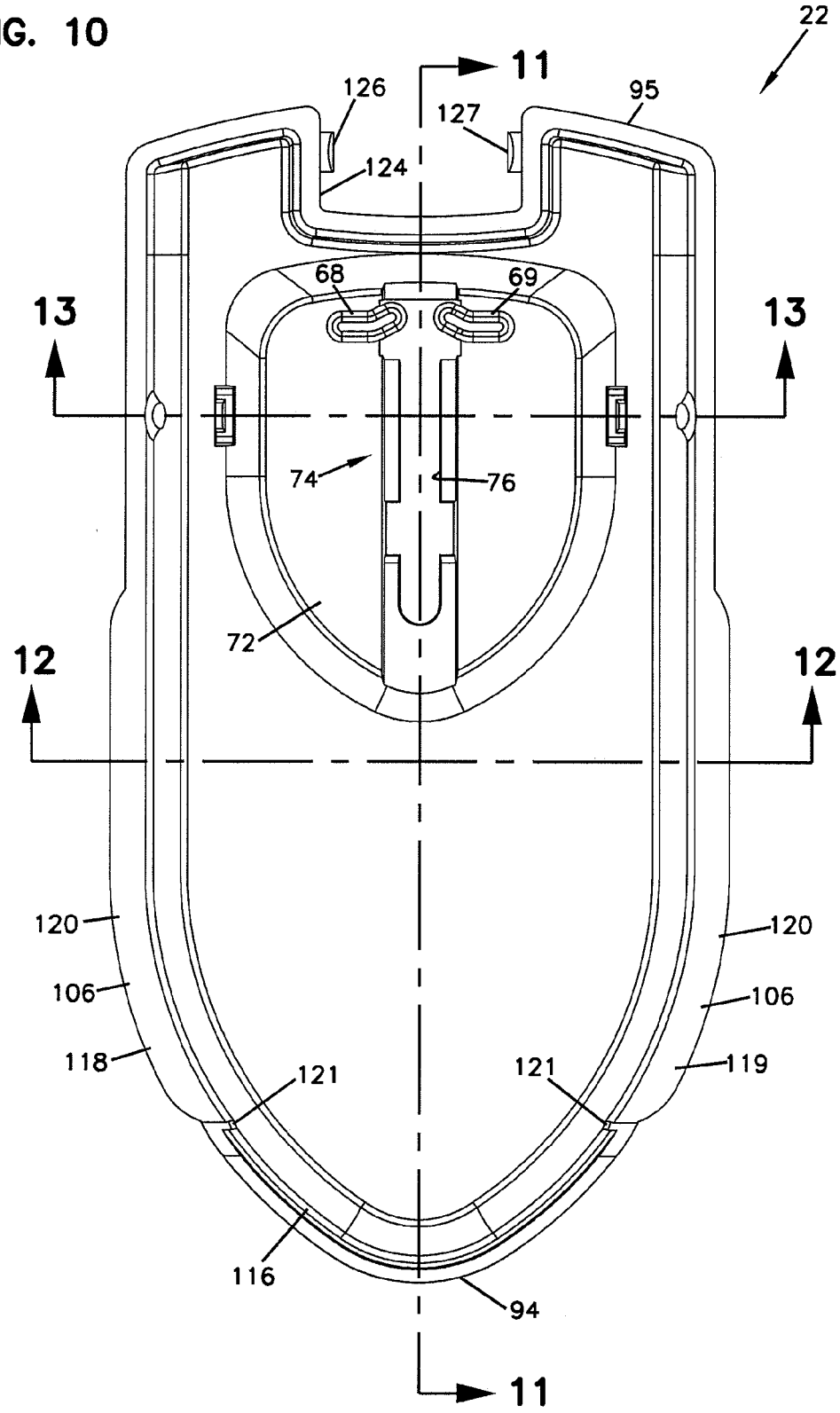
FIG. 10 is a top plan view of the base of FIG. 8.
Figure 12:
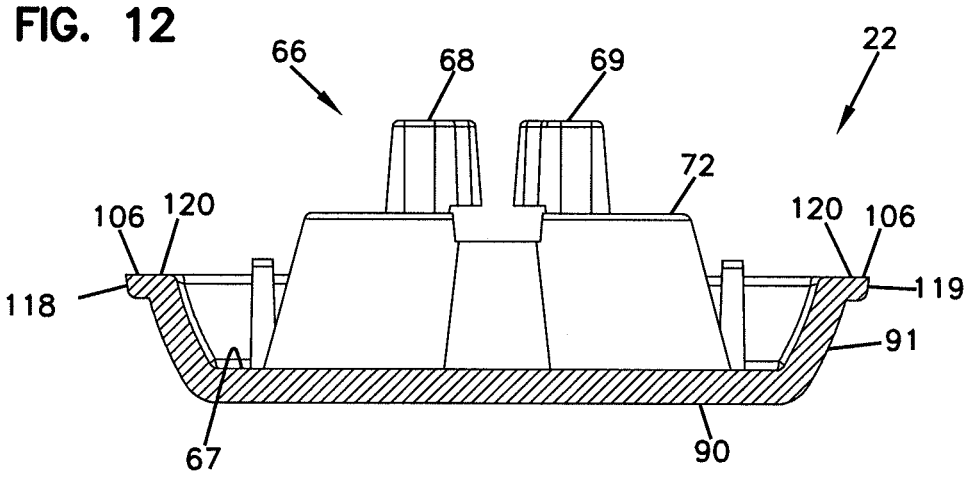
FIG. 12 is a cross-sectional view of the base of FIG. 8, the cross-section being taken along the line 12-12 of FIG. 10.
Figure 13:
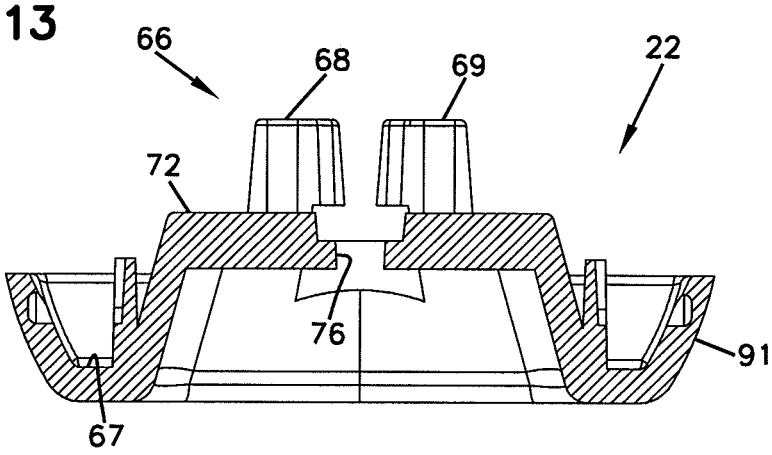
FIG. 13 is a cross-sectional view of the base of FIG. 8, the cross-section being taken along the line 13-13 of FIG. 10.

The platform 72 is generally sized a size sufficient to hold a pill 36, as well as the slidable fixture 34 and the back projection arrangement 66. In preferred embodiments, the platform 72 includes a slide track 74 (FIGS. 8-10). In this implementation, the slide track 74 is embodied as an open slot 76. The open slot 76 is sized to accommodate a slide rail 78. In this embodiment, the slide rail 78 is part of the slidable fixture 34 to help hold the slidable fixture 34 in place on the platform 72 while allowing the slidable fixture 34 to slide toward and away from the back projection arrangement 66. The slide rail 78 includes a tab 80 (FIG. 3), which slides along the slot 76, but on an opposite side of the platform 72 than a remaining portion of the slidable fixture 34. The tab 80 helps to secure the slidable fixture 34 in place on the platform 72, while still allowing it to slide within the slot 76.

In preferred implementations, the arm arrangement 40, finger tab 52, and slide rail 78 are an integral one-piece member 82. For example, member 82 can be made from a molded, plastic piece.

In this embodiment and in reference to FIG. 17, the slide rail 78 includes an indent 84 extending its length. The length of the slide rail 78 runs from a first end 86, which is proximate to and extends beyond the back projection arrangement 66, and a second end 87 which is proximate and extends beyond the finger tab 52. The indent 84 is collinear with the axis 38. The indent 84 is for receiving the cutting blade 26.

As can be seen in FIG. 17, in the preferred embodiment shown, the indent 84 is aligned with the gap 58 between the first and second projections 56, 57; the first and second bridges 62, 63; the first and second back projections 68, 69; and the first and second arms 41, 42. The cutting blade 26 penetrates the gap 58 and fits within the indent 84, when the cover 24 is pivoted to its closed position.

The base 22, in this embodiment, has a bottom wall 90 with a sidewall 91 extending there from. Together, the bottom wall 90 and sidewall 91 defines an interior 92.

The base 22 includes a front end 94 and an opposite rear end 95. The rear end 95 is the end in which the cover 24 is pivotably attached. In the interior 92, spaced between the front end 94 and the platform 72 is a volume 98 (FIG. 3), which can be used as a storage volume to hold pills 36, including pills that have already been split. In typical constructions, the sidewall 91 will extend at least 2 millimeters, not greater than 15 millimeters, and typically 5-10 millimeters from the bottom wall 90. In typical embodiments, the sidewall 91 will be shorter than the height of the platform 72. As can be seen in FIGS. 14-16, the front end 94 is tapered and rounded. Typically, the base 22 will have a length between the front end 94 and rear end 95 of at least 6 centimeters, no greater than 15 centimeters, and typically 7-10 centimeters. The width across the base 22 between opposite sidewalls 91 is at least 3 centimeters, no greater than 9 centimeters, typically 3.5-6 centimeters.

The cover 24 has a general overall shape sized to match overall shape of the base 22. In the embodiment shown, the cover 24 includes a top wall 100. Projecting from the top wall 100 along the perimeter and projecting in a direction toward the base 22 is a sidewall 102. The sidewall 102 defines a generally flat, horizontal edge 104, which engages a similar edge 106 that is part of the sidewall 91 of the base 22.

The cover 24 includes a front end 108 and a rear end 109, which are at opposite ends of each other and which engage the corresponding front end 94 and rear end 95 of the base 22 when the cover 24 is in the closed position relative to the base 22. The front end 108 has the same rounded profile shape as the front end 94.

The front end 108 defines a projecting ledge 112 that extends from the sidewall 102 and projects over the sidewall 91 of the front end 94 of the base 22. In general, this projecting ledge projects between 1-5 millimeters from the sidewall 102 of the front end 108. Part of the front end 108 also includes an extending wall 114, which extends or projects below the projecting ledge 112 in a direction toward the base 22. The extending wall 114 is received within a recess 116 (FIG. 3) defined by the front end 94 of the sidewall 91 of the base 22. In preferred embodiments, there is a slight interference fit, such that the engagement between the extending wall 114 and the recess 116 helps to hold the cover 24 in a closed position relative to the base 22.

The sidewall 91 of the base 22, in preferred embodiments, further include a pair of projecting handles 118, 119. The projecting handles 118, 119 are in the form of flanges 120 extending generally perpendicular to the sidewall 91. The flanges 120, in the embodiment shown, extend from a region 121, adjacent the front end 94 where the recess 116 ends, along the sidewall 91, to end at a location spaced from the rear end 95. In the embodiment shown, the flanges 120 extend between 40-80% of the length of the sidewall 91 as it extends from the rear end 95 to the front end 94. In use, the flanges 120 can be grasped, while the cover 24 is lifted from the base 22, to move the cover 24 from the closed position to the open position.

Figure 6:
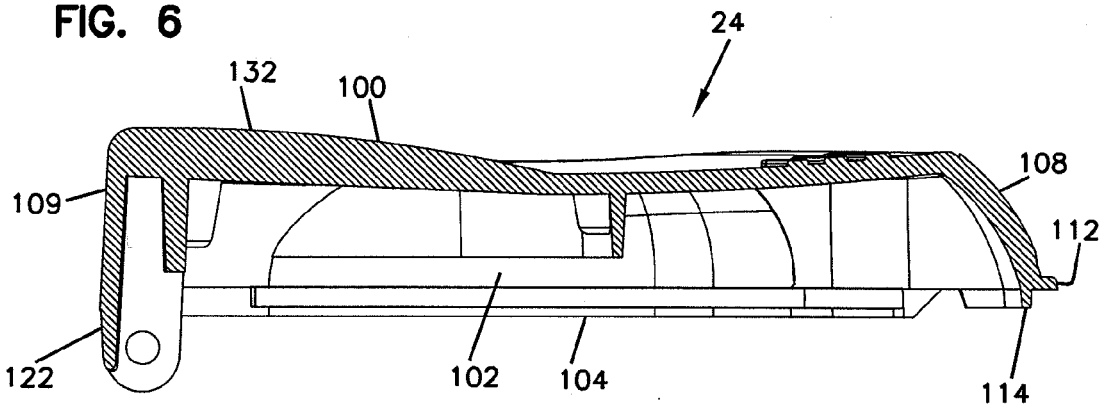
FIG. 6 is a cross-sectional view of the cover of FIG. 5, the cross-section being taken along the line 6-6 of FIG. 5.
Figure 7:
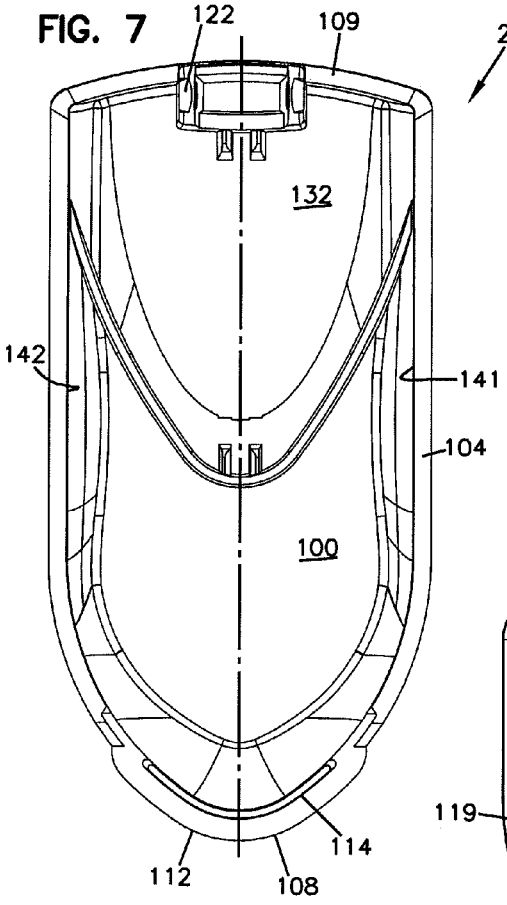
FIG. 7 is a bottom plan view of the cover of FIG. 5.

As mentioned above, the cover 24 is pivotally attached to the base 22. In FIG. 6, it can be seen how the rear end 109 of the cover 24 includes a hinge member 122 projecting from the sidewall 102 of the rear end 109. The hinge member 122 fits within and is received by a hinge recess 124, which is defined in the rear end 95 of the sidewall 91 of the base 22. The hinge member 122 is pivotally connected and pivots about a hinge pivot 126, 127, which is within the hinge recess 124 in the base 22.

Projecting down and extending from the inside surface 130 (FIG. 3) of the cover 24 is the cutting blade 26. In the embodiment shown, the cutting blade 26 extends along only a portion of the inside surface 130 (FIG. 3) of the cover 24. In the embodiment shown, the cutting blade 26 is adjacent the rear end 109 and extends in a direction toward the front end 108, only partially therealong. In this embodiment, the cutting blade 26 extends between 25-75% of the length of the cover 24, for example 35-65% of the length of the cover 24.

The cutting blade 26 is aligned with the axis 38 (FIG. 15), when the cover 24 is in the closed position. The cutting blade 26 has an edge sharpness sufficient to cut through a typical pharmaceutical tablet with an amount of force that most adults, including adults with infirmaries or dexterity issues, would be able to suffice. In the embodiment shown, the cutting blade 26 will have a length of at least 20 millimeters, typically 25-50 millimeters, and no greater than 90 millimeters.

In accordance with principals of this disclosure, the cover 24 is transparent. In preferred embodiments, at least a portion of the cover 24 that extends over the pill holder arrangement 28, when the cover 24 is closed, includes a magnifying lens 132, which is part of the cover 24. In this manner, the magnified area 134 helps the user of the pills splitter 20 to view the pill 36 within the pill holder arrangement 28 as the pill 36 is being split. In preferred embodiments, the magnification is about 1.5×. The magnified area 134, in one example, generally extends from the rear end wall 109 along the perimeter of the platform 72, such that it is only magnifying the pill holder arrangement 28. The remaining portion of the cover 24 may still be transparent, and it can also have some degree opaqueness to it. In other embodiments, the entire cover 24 can be magnified.

The pill splitter 20 further includes, in this embodiment, a shield 138 slidably secured to the cover 24. The shield 138 is constructed and arranged to cover the cutting blade 26 when the cover 24 is in the open position and expose the cutting blade 26 when the cover 24 is in the closed position. In this manner, when the cover 24 is in the open position, the shield 138 protects the user of the pill splitter from engagement or contact directly against the cutting blade 26. In use, as the cover 24 pivots relative to the base 22 to the closed position, the shield 138 is slid relative to the cover 24 to expose the cutting blade 26 and allow the cutting blade 26 contact with the pill 36.

In this embodiment, the sidewall 102 of the cover 24 includes first and second slide tracks 141, 142, each extending from a position just adjacent to the rear end 109 to a position adjacent to where the extending wall 114 at the front end 108 ends. The shield 138 has a thickness of a size suitable to slide within the slide tracks 141, 142.

The shield 138 has a rounded front end 144 and a straight rear end 145. Extending between the rear end 145 and front end 144 is a first side 146 and second side 147. The first side 146 slides within the slide track 141, while the second side 147 slides within the slide track 142.

To help move the shield 138 from a safety position (FIG. 1) in which the shield 138 is covering the cutting blade 26 when the cover 24 is in the open position, and an exposed position in which the shield 138 is exposing the cutting blade 26 (FIG. 3), there are first and second levers 151, 152. The first and second levers 151, 152 are rotably connected to a portion of the base 22 at one end 154, 155, and to the rear end 145 of the shield 138. In FIGS. 1 and 14-16, it can be seen how the first and second levers 151, 152 have a base end 154, 155 (FIG. 14) which pivots around an axis 156, 157 (FIG. 15). Each axis 156, 157 is spaced from the rear end 95 of the base and extends between the sidewall 91 and the platform 72. This base end 154, 155 is fixed in place along the base 22, while the shield end 158, 159 (FIG. 1) of each lever 151, 152 is pivotally secured to the rear end 145 of the shield 138. As such, when the cover 24 is moved from the open position of FIG. 1 to the closed position of FIG. 3, the first and second levers 151, 152 pivot about axes 156, 157 and translate a pushing force to the shield 138, so that the first and second sides 146, 147 slide within each slide track 141, 142 to move the shield 138 relative to the cover 24 from the cover rear end 95 to the cover front end 94 and expose the cutting blade 26.

A method of splitting a pill should now be apparent from the above. In reference to FIGS. 14-15, to split, such as pill 36, the pill splitter 20 is provided. The pill 36 is placed in the pill holder arrangement 28 in the base 22. The slidable fixture 34 is pushed to secure the pill 36 in the pill holder arrangement 28. Finally, the cover 24 is closed over the base 22 to engage the cutting blade 26 against the pill 36 and split the pill 36 within the pill holder arrangement 28.

After closing the cover 24, the method can include viewing the pill 36 in the pill holder arrangement 28 through the magnified lens 132 that is part of the cover 24.

The above represents example, principals and embodiments. Many embodiments can be made.

What is claimed is:

1. A pill splitter comprising:

(a) a base;

(b) a cover pivotably secured to the base; the cover being pivotable between (i) an open position in which the cover is away from the base and the base is exposed, and (ii) a closed position in which the cover is over the base and the base is covered;

(c) a cutting blade attached to the cover; and (d) a pill holder arrangement including a slidable fixture constructed and arranged to be moveable relative to the base and hold a pill; the pill holder arrangement being in the base and arranged relative to the cutting blade to allow a pill to split when the cover is in the closed position;

(i) the pill holder arrangement including a platform raised in height relative to a remaining portion of the base;

(ii) the platform including a slide track; and (iii) the slidable fixture includes a rail slidably held within the track.

2. The pill splitter of claim 1 wherein the slidable fixture includes an arched arm arrangement.

3. The pill splitter of claim 2 wherein the pill holder arrangement includes a rigid back projection arrangement opposing the arched arm arrangement.

4. The pill splitter of claim 3 wherein the slidable fixture includes a finger tab connected to the arm arrangement; the finger tab constructed and arranged to accept force to move the slidable fixture relative to the base.

5. The pill splitter of claim 4 wherein the rigid back projection arrangement, the arched arm arrangement, and the finger tab each define a gap; the cutting blade penetrating each gap when the cover is in the closed position.

6. The pill splitter of claim 1 wherein the pill holder arrangement includes a rigid back projection arrangement constructed and arranged to cooperate with the slidable fixture and hold a pill between at least a portion of the slidable fixture and the rigid back projection arrangement.

7. The pill splitter of claim 1 wherein the slidable fixture includes:

(a) an arched arm arrangement secured to the rail; and (b) a finger tab connected to the arm arrangement and the rail; the finger tab constructed and arranged to accept force to move the rail within the slide track thereby moving the slidable fixture relative to the platform.

8. The pill splitter of claim 7 wherein the arched arm arrangement, the finger tab, and the rail are an integral one piece member.

9. The pill splitter of claim 1 further comprising: a shield slidably secured to the cover; the shield being constructed and arranged to cover the cutting blade when the cover is in the open position and expose the cutting blade when the cover is in the closed position.

10. The pill splitter of claim 1 wherein the cover is transparent and includes a magnifying lens positioned over the pill holder arrangement when the cover is in the closed position.

11. A pill splitter comprising:

(a) a base;

(b) a cover pivotably secured to the base; the cover being pivotable between (i) an open position in which the cover is away from the base and the base is exposed, and (ii) a closed position in which the cover is over the base and the base is covered;

(c) a cutting blade attached to the cover;

(d) a platform raised in height relative to a remaining portion of the base, wherein the platform includes a slide track;

(e) an arm arrangement shaped to include a bight section; and (f) a rail secured to the arm arrangement, the rail being slidably held within the slide track.

12. The pill splitter of claim 11 wherein the platform is secured to the base.

13. The pill splitter of claim 11 further including a finger tab connected to the arm arrangement and constructed and arranged to accept force.

14. The pill slitter of claim 11 further comprising: a shield slidably secured to the cover; the shield being constructed and arranged to cover the cutting blade when the cover is in the open position and expose the cutting blade when the cover is in the closed position.

15. The pill splitter of claim 11 wherein the cover is transparent and includes a magnifying lens positioned over the platform when the cover is in the closed position.

* * * * *